US009329005B2

(12) United States Patent
Meier et al.

(10) Patent No.: US 9,329,005 B2
(45) Date of Patent: May 3, 2016

(54) EXPANDABLE ARROW NOCK

(71) Applicants: Brian Scott Meier, Sapulpa, OK (US); Eric Ryan Tabor, Coweta, OK (US)

(72) Inventors: Brian Scott Meier, Sapulpa, OK (US); Eric Ryan Tabor, Coweta, OK (US)

( * ) Notice: Subject to any disclaimer, the term of this patent is extended or adjusted under 35 U.S.C. 154(b) by 0 days.

(21) Appl. No.: 14/479,166

(22) Filed: Sep. 5, 2014

(65) Prior Publication Data

US 2015/0176953 A1 Jun. 25, 2015

Related U.S. Application Data

(60) Provisional application No. 61/874,335, filed on Sep. 5, 2013.

(51) Int. Cl.

| | |
|---|---|
| ***F42B 6/04*** | (2006.01) |
| ***F42B 6/06*** | (2006.01) |
| ***F42B 12/34*** | (2006.01) |
| ***F42B 12/38*** | (2006.01) |
| ***F42B 12/36*** | (2006.01) |

(52) U.S. Cl.
CPC . *F42B 6/06* (2013.01); *F42B 12/34* (2013.01); *F42B 12/365* (2013.01); *F42B 12/385* (2013.01)

(58) Field of Classification Search
CPC ..... F42B 6/04; F42B 6/06; F42B 12/385
See application file for complete search history.

(56) References Cited

U.S. PATENT DOCUMENTS

| | | | | |
|---|---|---|---|---|
| 3,993,311 | A | 11/1976 | Johnson | |
| 4,836,557 | A * | 6/1989 | Polando | 473/578 |
| 6,764,420 | B2 | 7/2004 | Cyr et al. | |
| 8,216,097 | B2 * | 7/2012 | Nick et al. | 473/586 |
| 8,323,132 | B2 | 12/2012 | Kirsch | |
| 8,771,111 | B2 | 7/2014 | Hand | |
| 8,821,325 | B2 * | 9/2014 | Kirsch | 473/578 |
| 2003/0176245 | A1 * | 9/2003 | Cyr et al. | 473/578 |
| 2010/0035709 | A1 * | 2/2010 | Russell et al. | 473/570 |

OTHER PUBLICATIONS

Written Opinion of PCT/US2015/018808.

* cited by examiner

*Primary Examiner* — John Ricci
(74) *Attorney, Agent, or Firm* — Martin S. High, P.C.

(57) ABSTRACT

Embodiments of the Expandable Arrow Nock are comprised of a nock tip, expandable fins, an internal spring, a high tensile strength wire and a pass-through module. When the arrow is fired, the fins are in the stowed position and remain in the stowed position as the arrow travels up to the point where the arrow hits the target animal. At the point where the arrow hits the target animal, the deceleration of the arrow at that instant actuates the compressed internal spring that in turn force the fins into the deployed or open position. The deployed fins prevent the nock from travelling through the body of the animal. However, the shaft portion of the arrow detaches from the nock and pass-through module.

8 Claims, 6 Drawing Sheets

EXPANDABLE ARROW NOCK

CROSS-REFERENCE TO RELATED APPLICATIONS

This application is a non-provisional patent application of U.S. provisional patent application with Ser. No. 61/874,335 titled "Expandable Arrow Nock" filed on Sep. 5, 2013. This application claims priority of U.S. provisional patent application with Ser. No. 61/874,335. Further, the entire contents of U.S. provisional patent application with Ser. No. 61/874,335 are herein incorporated by reference.

STATEMENT REGARDING FEDERALLY SPONSORED RESEARCH OR DEVELOPMENT

Not applicable

BACKGROUND OF THE EMBODIMENTS

1. Field of the Embodiments

The general field of the embodiments of the Expandable Arrow Nock is archery. More specifically the field of the embodiments relates to detachable arrow nocks.

2. Description of Prior Art

The standard arrow nock is typically a piece of polymeric, metallic, or wooden material that forms a notch in which the bow string is engaged to the arrow. One drawback of standard arrows used in hunting is that all too commonly the arrow passes entirely through the target or game and exits out the other side of the target game animal and becomes lodged in the vegetation or terrain around the animal. When the arrow passes straight through target game animal the arrow does not do sufficient internal damage to the animal to immediately bring down the animal. Commonly, the target game animal runs from the location of the shot, cannot be located by the hunter, and is lost. This is a significant unrecoverable monetary expense to the hunter who has dedicated significant resources to purchase hunting equipment, traveled a significant distance to the hunting grounds, and secured the necessary resources for the hunt. Also, losing a wounded target game animal is a waste of natural resources and an ethical quandary for the sportsman. The embodiments of the Expandable Arrow Nock addressed the shortcomings of the prior art.

SUMMARY OF THE EMBODIMENTS

Embodiments of the Expandable Arrow Nock are comprised of a nock tip, expandable fins, an internal spring, a high tensile strength wire and a pass-through module. When the arrow is fired, the fins are in the stowed position and remain in the stowed position as the arrow travels up to the point where the arrow hits the target animal. At the point where the arrow hits the target animal, the deceleration of the arrow at that instant actuates the compressed internal spring that in turn force the fins into the deployed or open position. The deployed fins prevent the nock from travelling through the body of the animal. However, the nock portion of the arrow detaches from the shaft of the arrow that contains the pass-through module. The arrow continues to travel through the animal and potentially out the other side of the animal if the inertia of the now detached arrow is sufficient. The pass-through module and the nock are connected by a high-tensile wire or string. When the string reaches its total length, the pass-through module will be stopped and the arrow shaft will continue. In sum, the expandable fins then cause the entire configuration of nock, high-tensile wire or string, and pass-through module to remain with the animal as the arrow passes through.

There has thus been outlined, rather broadly, the more important features of the embodiments of the Expandable Arrow Nock in order that the detailed description thereof that follows may be better understood, and in order that the present contribution to the art may be better appreciated. There are, of course, additional features of the embodiments that will be described hereinafter and which will form the subject matter of the claims appended hereto.

In this respect, before explaining at least one embodiment of the embodiments in detail, it is to be understood that the embodiment is not limited in this application to the details of construction and to the arrangements of the components set forth in the following description or illustrated in the drawings. The embodiment or embodiments are capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be used as a basis for the designing of other structures, methods and systems for carrying out the several purposes of the embodiments. Additional benefits and advantages of the embodiments will become apparent in those skilled in the art to which the present embodiments relates from the subsequent description of the preferred embodiment and the appended claims, taken in conjunction with the accompanying drawings. It is important, therefore, that the claims be regarded as including such equivalent constructions insofar as they do not depart from the spirit and scope of the embodiments.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the embodiments of the application which is measured by the claims, nor is it intended to be limiting as to the scope of the embodiments in any way.

DETAILED DESCRIPTION OF THE PREFERRED EMBODIMENTS

Figures 1A, 1B:
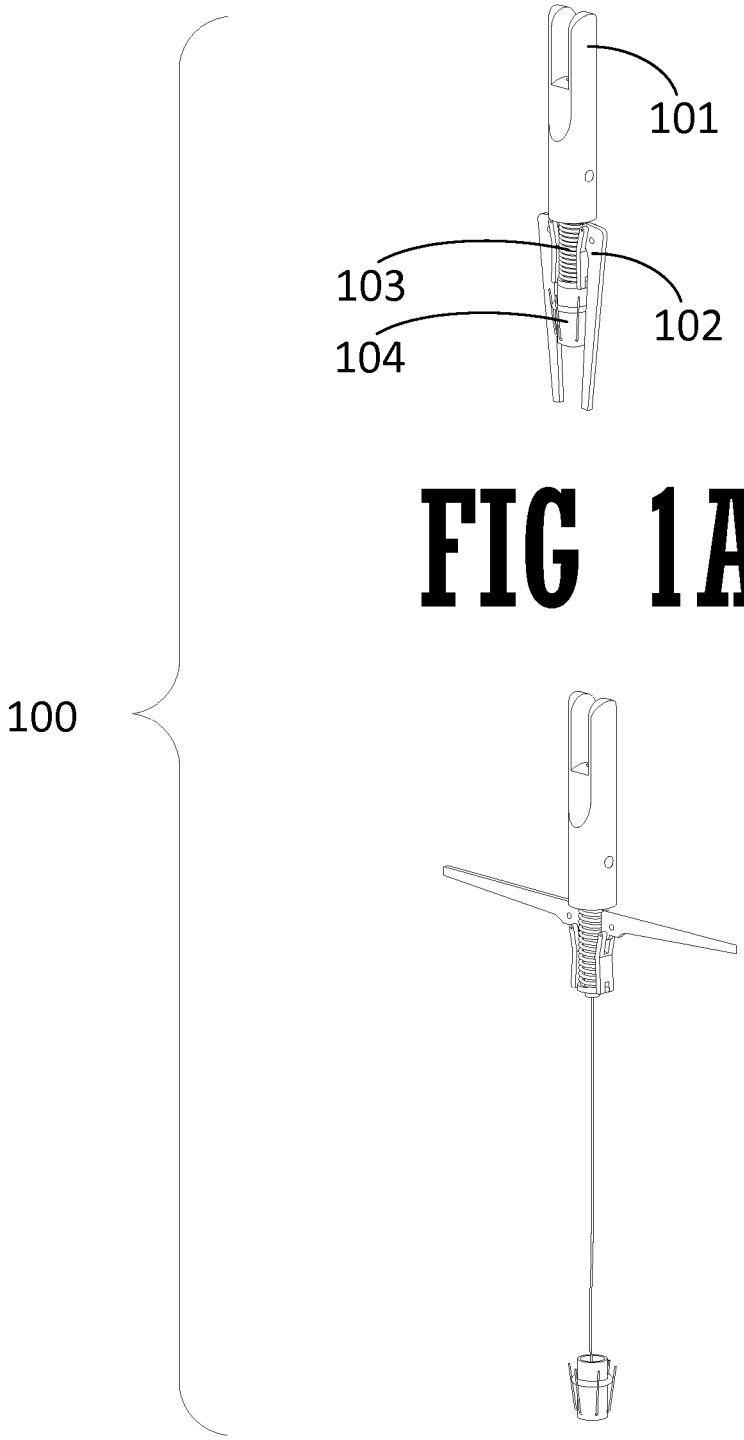
FIG. 1A is a perspective view of an embodiment of the expandable arrow nock showing the fins in the firing or stowed position.
FIG. 1B is a perspective view of the expandable arrow nock showing the fins in the deployed position.
Figure 2C:
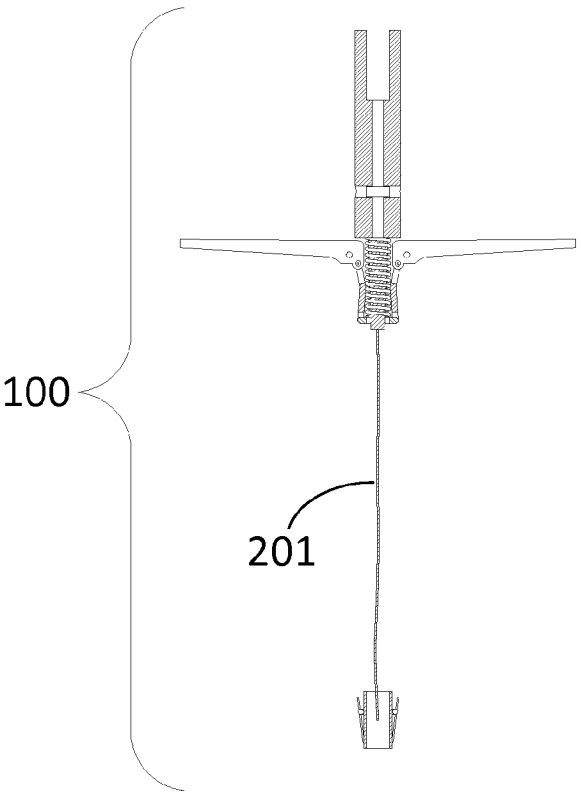
FIG. 2C is a front view of the expandable arrow nock shown in the deployed configuration with the arrow attached to the expandable arrow nock via the high tensile strength wire.
Figure 2B:
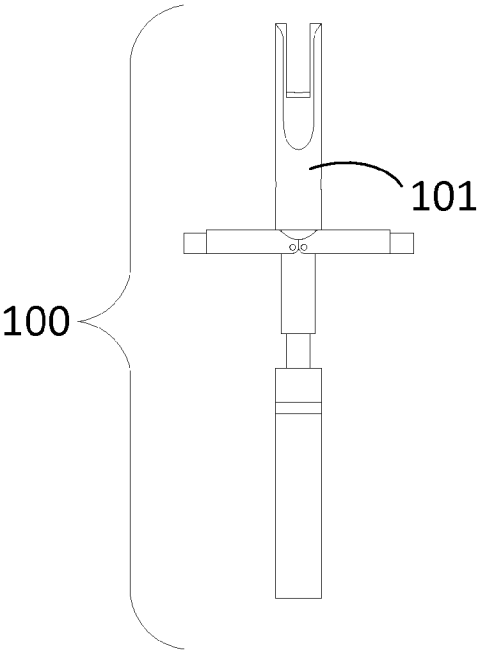
FIG. 2B is a front view of an embodiment of the expandable arrow nock showing the fins in the deployed position.
Figure 2A:
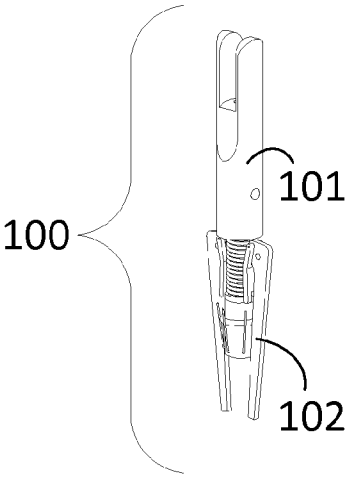
FIG. 2A is a perspective view of an embodiment of the expandable arrow nock shown in the firing or stowed position.
Figure 3:
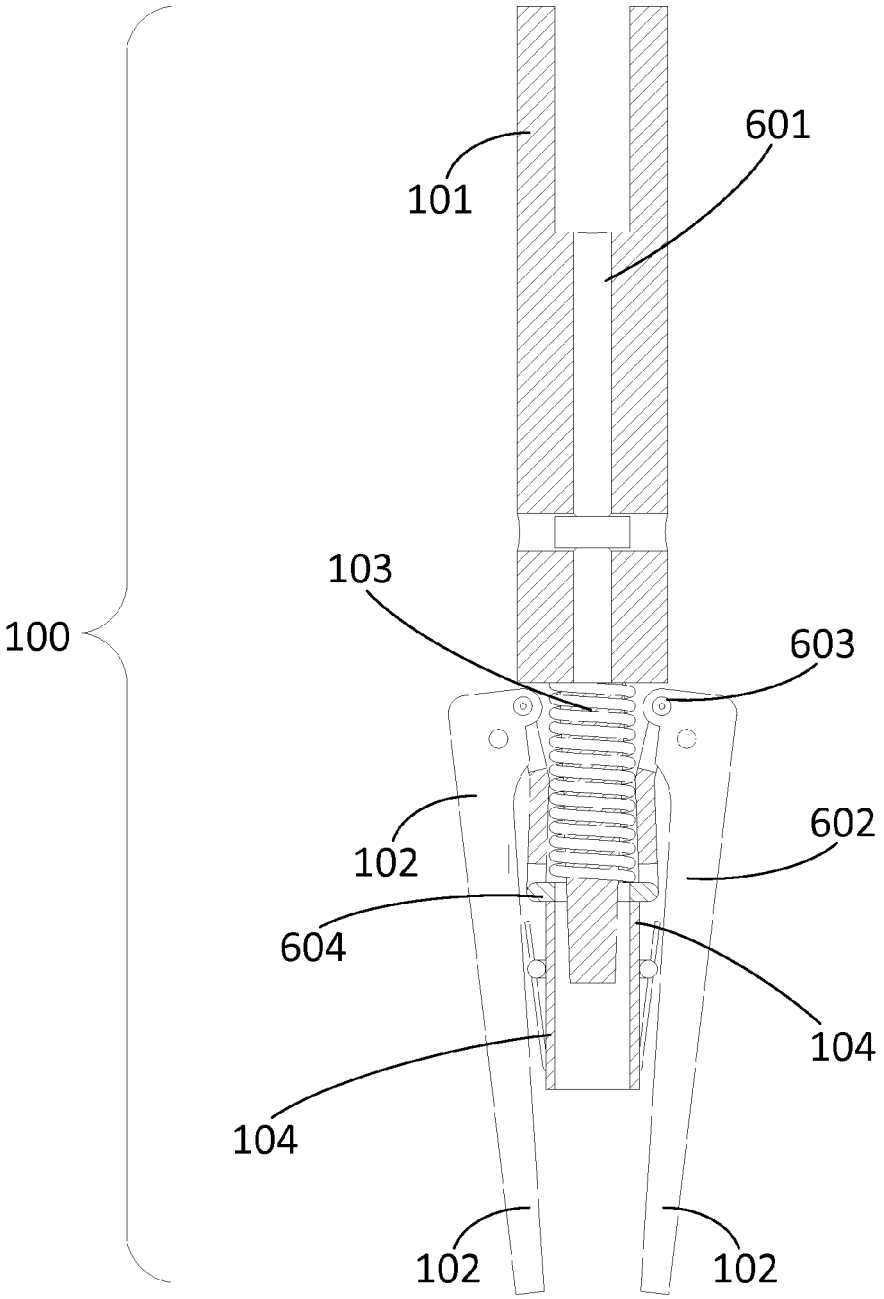
FIG. 3 is a sectional view of an embodiment of the expandable arrow nock showing how the arrow is engaged into the arrow nock in the to-be-fired position.
Figure 4:
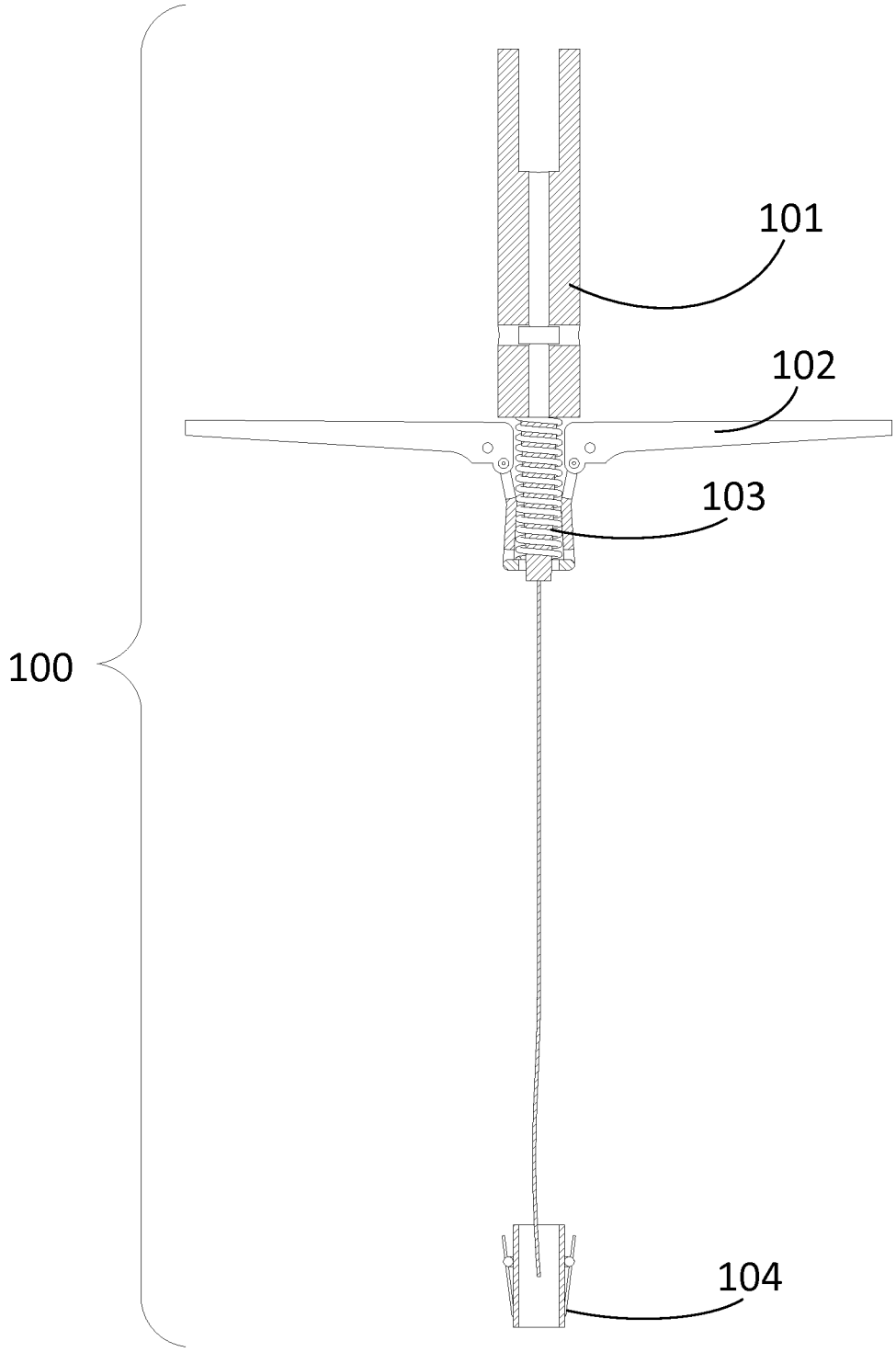
FIG. 4 is a schematic view of the expandable arrow nock showing the configuration of the internal spring and the fins and the pass-through of the high tensile strength wire to the arrow from the nock.
Figure 5:
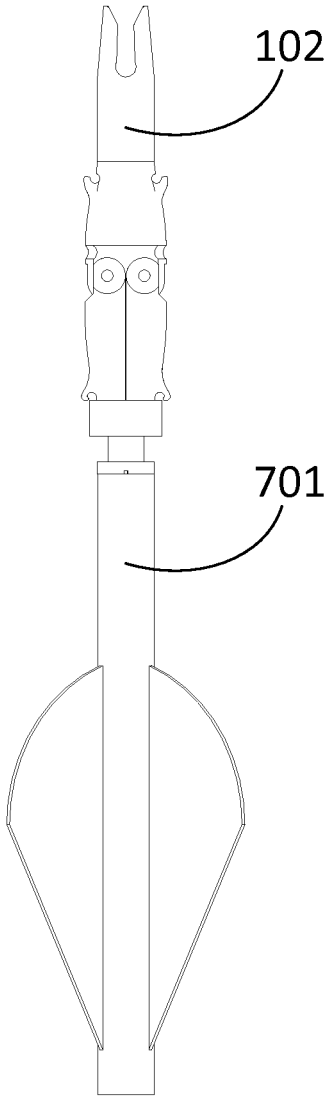
FIG. 5 is a schematic view of another embodiment of the expandable arrow nock showing the configuration of the arrow nock in the to-be-fired position.
Figure 6:
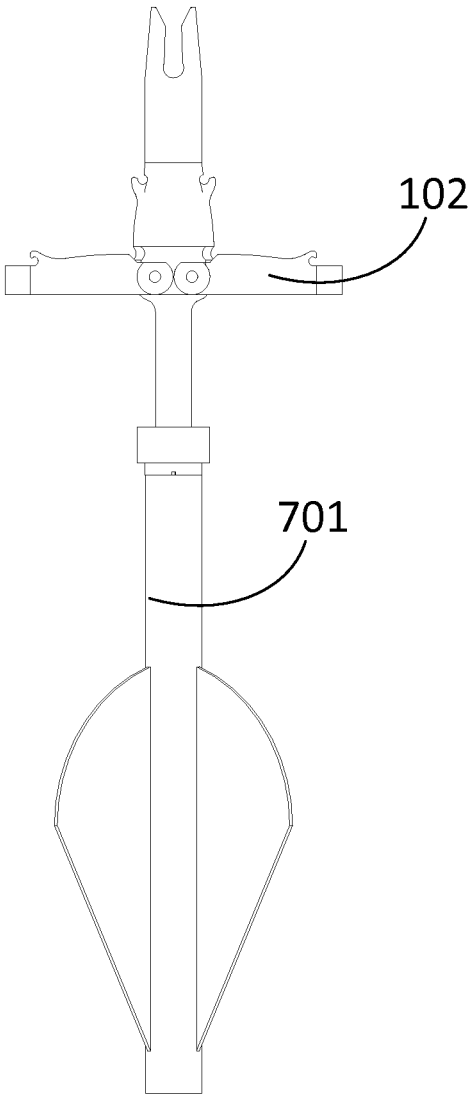
FIG. 6 is a schematic view of another embodiment of the expandable arrow nock showing the configuration of the arrow nock in the expanded position.

Embodiments of the Expandable Arrow Nock 100 are comprised of a nock tip 101, expandable fins 102, an internal spring 103, a high tensile strength wire 201 and a pass-through module 104.

In the to-be-fired configuration the expandable fins 102 of the expandable arrow nock 100 are in the stowed or firing configuration. This allows the arrow to be placed in the firing position on the bow string and allows the arrow to be fired. The arrow is attached through the pass-through module 104 which connects the expandable arrow nock to the pass-through module arrow through the high-tensile wire. The arrow nocks are activated via closing a switch by including electronic activation.

The nock tip 101 forms apertures 601 to allow sound to escape the Expandable Arrow Nock 100 when the expandable fins 102 deploy lessening the chance of alerting the target animal of the flight of the arrow.

The expandable fins 102 are comprised of fins 602 connected to a pivot point 603 that allows the spring loaded fins 602 to expand. The fins 602 are triggered to expand once the arrow hits the target animal. The spring 103 is connected to the fin latch 604 which releases the fins 602 to the expanded position. As the arrow strikes the target, the target exerts a force on the arrow in the direction opposite of the travel of the arrow. As this force begins to act upon the arrow and its components, a latch holding back the spring 604 is forced out of the line of travel of the spring 103. The expandable fins 102 are then deployed and the expandable fins 102 halt the nock at the entry side of the target. In addition, the shaft and pass-through components 104 contained therein are separated from the nock and continue through the target. As the high-tensile strength wire/string 201 reaches its total length, the pass-through is pulled from the arrow shaft. As this occurs the inertia acting upon the pass-through pulls tight the wire/string 201 connected between the nock and pass-through. This in turn closes a circuit through a switch located in the nock, or pass-through, or both and activates audible, visual, and or electronic tracking devices.

The nock 101 and the pass-through module 104 are comprised of location finding devices. These location finding devices can be audible, visual, or global positioning (GPS) based devices. The nock 101 and the pass-through module 104.

In one mode of operation of the embodiments, when the user releases the bowstring, the potential energy stored in the bow acts upon the arrow, and its components. The bowstring exerts a force in the direction of the travel of the arrow. This inertial force acts upon a switch that is calibrated to close or open at an unknown g or kg force. Once this switch is actuated the following steps are made either immediately or through a given time delay: 1) An audible device used for locating through audible senses or electronic device begins sounding on the nock, the pass through, or both; 2) A visual device such as a light, laser, strobe, or facsimile of these begins lighting on the nock, the pass through, or both; 3) An electronic signal begins that is traceable through electronic means and is silent. This electronic locating signal comprises GPS, Bluetooth, WiFi, low power radio frequency, or any signal that would provide the same electronic traceability. The arrow nocks are activated via closing a switch by including electronic activation.

Upon impact of the head of the arrow, a force acts upon the arrow, and its components, in the direction opposite of the travel of the arrow causing the arrow to decelerate. This force causes the switch that was closed/opened in step one to do the opposite (open/close) which causes the following steps to take place: 1) A catch or stop that is used for the spring (internal in the nock), and pass through release is moved out of the way in preparation for the springs PE to be released and the stopping fins to be deployed and/or the pass through to be released; 2) The spring is released and the fins are deployed to the outward position; 3) As the arrow passes through the target, the deployed fins halt the nock at the entry side. The deceleration force on the deployed fins pulls the nock free from the arrow shaft and the arrow shaft continues through the target with the pass through portion still remaining inside the shaft, but connected through a spool of wire/string/cord to the nock. As the travel of the shaft continues through the target, the wire/string/cord begins to unspool until it reaches its full length. Upon reaching full length the pass through is pulled free of the shaft of the arrow, and the shaft continues.

In another mode of operation of the embodiments, when the user releases the bowstring, the potential energy stored in the bow is transferred to the arrow, and its components, by producing a force in the direction of the travel of the arrow. Upon impact of the head of the arrow on the target, a force begins acting upon the arrow, and its components, in the direction opposite to the travel of the arrow. This inertial force acts upon a switch that is calibrated to close or open at an unknown force. Once this switch is closed/open the following steps are made either immediately or through a given time delay: 1) An audible device used for locating through audible senses or electronic device begins sounding on the nock, the pass through, or both; 2) A visual device such as a light, laser, strobe, or facsimile of these begins lighting on the nock, the pass through, or both; 3) An electronic signal begins that is traceable through electronic means and is silent. This electronic locating signal could be GPS, Bluetooth, WiFi, low power radio frequency, or any signal that would provide the same electronic traceability; 4) A catch or stop that is used for the spring (internal in the nock), and pass through release is moved out of the way in preparation for the springs PE to be released and the stopping fins to be deployed and/or the pass through to be released; 5) The spring is released and the fins are deployed to the outward position; 6) As the arrow passes through the target, the deployed fins halt the nock at the entry side. This decelerating force pulls the nock free from the arrow shaft and the arrow shaft continues through the target with the pass through portion still remaining inside the shaft, but connected through a spool of wire/string/cord to the nock; 7) As the travel of the shaft continues through the target, the wire/string/cord begins to unspool until it reaches its full length. Upon reaching full length the pass through is pulled free of the shaft of the arrow, and the shaft continues. Alternatively, as the pass through reaches the end of its travel, the string/wire pulls taught against the nock. As the wire pulls tight, a switch is made which activates the audible, visual, and/or electronic locating devices.

In another embodiment of the Expandable Arrow Nock, the embodiments comprise user wireless activation or deactivation of the tracking devices (audible, visual, and electronic) so that after release of the arrow the audible, visual, and electronic tracking beacons can be activated or deactivated if something goes wrong or when the target is located.

In another embodiment of the Expandable Arrow Nock, the embodiments may be adapted for use in crossbows. In addition, embodiments of the Expandable Arrow Nock may be used. For the crossbow application, the embodiments will operate in a similar manner. Rather the nock portion of the embodiments are a slightly different shape to accept a crossbow.

In another embodiment of the Expandable Arrow Nock, the embodiments comprise extending the nock on the arrow shaft so as to allow the fins room to deploy so that they do not have to rest in the stowed position on the arrow shaft itself. See FIGS. 7 and 8.

In another embodiment of the Expandable Arrow Nock, the embodiments comprise a means to deploy the nock on the nock itself. These embodiments comprise a collar around the fins that slides down by the force of impact causing the spring loaded fins to deploy to the outward position.

What we claimed is:

1. An expandable separable arrow nock comprised of
a nock that is separable from the arrow shaft,
expandable fins located on the nock,
an internal spring located in the nock for the purpose of deploying fins on the nock,
a high tensile strength wire,
a pass-through module located on the nock,
and
a location finding device, contained within the nock, within the pass-through module, or both the nock and the pass-through module.

2. The expandable separable arrow nock in claim 1 comprised of a retention collar on the outside of the nock fins that holds the fins in the stowed position.

3. The expandable separable arrow nock in claim 1 comprised of elastic bands mounted on the outside of the nock to aid in deployment of the fins.

4. The expandable separable arrow nock in claim 1 comprised of an internal spring that is mounted on the inside of the nock to aid in deployment of the fins.

5. The expandable separable arrow nock in claim 1 comprised of a nock anchor.

6. The expandable separable arrow nock in claim 1 wherein the system can be located through audible, visual, electronic signaling, or any combination.

7. An expandable separable arrow nock comprised of
expandable fins deployed by an internal coil spring;
an internal catch that holds the fins in a stowed position that moves out of the way to allow the coiled spring to uncoil thus moving the fins to a deployed position;
wherein the expandable fins when deployed halt the nock on the impact side of the target, which removes the nock from the arrow shaft;
wherein as the shaft of the arrow continues its travel through the target, a pass-through module exits the shaft due to a linkage between the nock being affixed to the impact side of the target and high tensile strength wire of a certain length;
wherein upon exit of the pass-through module, it exits the opposite side and may have its own tracking/locating system;
wherein upon deployment of the fins, either through mechanical switch or inertial sensing, a tracking/locating system is actuated; and
wherein the system can be located through audible, visual, electronic signaling, or any combination.

8. An expandable separable arrow nock comprised of
expandable fins;
an nock anchor;
wherein the nock is offset or extended away from the shaft for the purpose of giving a more aerodynamic characteristic to the nock itself because the fins lay flat up against the nock itself;
wherein the fins are held in the stowed position via a retention collar;
wherein as the retention collar slides past the end of the fins, it allows the fins to deploy to the outward position;
wherein the retention collar is moved via the inertia created by the arrow slowing down;
wherein the source of the force that deploys the fins is an external band, an internal spring, an external spring, or other potential energy storage device; and
wherein the nock anchor is directly affixed to the nock and the nock anchor affixes the nock into the internals of the target.

* * * * *